US008413406B2

(12) United States Patent
Jablonka et al.

(10) Patent No.: US 8,413,406 B2
(45) Date of Patent: Apr. 9, 2013

(54) FOUNDATION WALL FOOTING BARRIER

(75) Inventors: Marcus Jablonka, Vineland (CA); Joern Schroeer, Herdecke (DE); Heinz-Peter Raidt, Dortmund (DE)

(73) Assignee: Ewald Doerken, Herdecke (DE)

( * ) Notice: Subject to any disclaimer, the term of this patent is extended or adjusted under 35 U.S.C. 154(b) by 124 days.

(21) Appl. No.: 12/694,662

(22) Filed: Jan. 27, 2010

(65) Prior Publication Data

US 2011/0146167 A1 Jun. 23, 2011

(30) Foreign Application Priority Data

Nov. 20, 2009 (CA) ..... 2686107

(51) Int. Cl.
*E04B 1/00* (2006.01)
*E04B 5/00* (2006.01)
*E02D 19/00* (2006.01)

(52) U.S. Cl.
USPC ..... 52/746.1; 52/169.14; 52/741.4; 52/408

(58) Field of Classification Search ..... 52/169.14, 52/408, 741.4, 169.1, 169.9, 411, 412
See application file for complete search history.

(56) References Cited

U.S. PATENT DOCUMENTS 3,407,552 A * 10/1968 Cassidy ..... 52/169.5
4,359,845 A * 11/1982 Harrison ..... 52/169.6
4,390,585 A * 6/1983 Holden ..... 428/172
4,745,716 A * 5/1988 Kuypers ..... 52/169.5
4,907,386 A * 3/1990 Ekroth ..... 52/169.14
5,337,533 A * 8/1994 Kajita ..... 52/741.1
5,794,388 A * 8/1998 Jackman ..... 52/169.5
5,845,456 A 12/1998 Read
5,857,297 A * 1/1999 Sawyer ..... 52/169.5
5,934,036 A * 8/1999 Gallagher, Jr. ..... 52/323
6,279,275 B1 * 8/2001 Sawyer ..... 52/169.5
6,460,305 B1 * 10/2002 VanHaitsma et al. ..... 52/483.1
7,181,888 B1 * 2/2007 Facaros ..... 52/169.5
7,437,855 B2 * 10/2008 Locke et al. ..... 52/169.14
7,789,740 B2 * 9/2010 Janesky ..... 454/251
7,856,767 B2 * 12/2010 Janesky ..... 52/169.14
2001/0000371 A1 * 4/2001 Traxler ..... 52/169.14
2002/0152696 A1 * 10/2002 Ruiz et al. ..... 52/169.5
2003/0131544 A1 * 7/2003 Miller ..... 52/169.1
2007/0224003 A1 * 9/2007 Janesky ..... 405/270
2007/0266658 A1 * 11/2007 Lyden ..... 52/292

* cited by examiner

*Primary Examiner* — Mark Wendell
(74) *Attorney, Agent, or Firm* — Bachman & LaPointe, P.C.

(57) ABSTRACT

In a foundation assembly, a moisture barrier is placed on a footing and a foundation wall is on the moisture barrier. The moisture barrier thus isolates the foundation wall from the footing. The footing defines a keyway. The moisture barrier comprises a waterproof layer, a bottom layer attached to bottom side of the waterproof layer, and a top layer attached to the top side of the waterproof layer. The waterproof layer blocks passage of water therethrough. The bottom layer is for attaching the moisture barrier to the footing, and comprises a material that attracts water and binds to cement. The moisture barrier comprises a keyway portion sufficiently flexible and configured to fit the keyway in the footing. When the keyway portion fits to the keyway on the footing, it defines a secondary keyway for receiving a key portion of the foundation wall.

20 Claims, 5 Drawing Sheets

FOUNDATION WALL FOOTING BARRIER

FIELD OF THE INVENTION

The present invention relates to footing barriers for foundation walls.

BACKGROUND OF THE INVENTION

Structural building walls, such as foundation walls, and interior walls can be damaged, or even fail, if exposed to water for a prolonged period of time. Water may be present in liquid or gas phase, such as in moisture or vapor form.

Small to moderate amounts of moisture typically can escape without causing damage. Recent building techniques, however, have been sealing walls with vapor barriers. At the same time such seals can trap even small amounts of moisture, which in turn may cause damage.

For example, it is now increasingly common to thermally insulate basement walls, and consequently to install moisture and vapor barriers on one or both sides of the walls. While the moisture and vapor barriers can prevent outside moisture from getting into the walls through the sides, they can also trap any moisture that has migrated into the wall.

Leakage water can be drained through drain conduits, as described, for example, in U.S. Pat. No. 5,845,456 to Read, issued Dec. 8, 1998 ("Read").

However, even when drainage is used, water damage can still occur in building walls, particularly basement walls with full height thermal insulation.

SUMMARY OF THE INVENTION

In accordance with an aspect of the present invention, there is provided a moisture barrier for isolating a foundation wall from a footing in a building. The moisture barrier comprises a waterproof layer for blocking passage of water through the moisture barrier, the waterproof layer having a bottom side and a top side; a bottom layer attached to the bottom side of the waterproof layer, for attaching the moisture barrier to the footing, the bottom layer comprising a material that attracts water and binds to cement; and a top layer attached to the top side of the waterproof layer, for contacting the foundation wall, wherein the moisture barrier comprises a keyway portion, the keyway portion being sufficiently flexible and being configured to fit a keyway in the footing. The bottom layer may be permeable to a fluid comprising water and cement. The waterproof layer may comprise one or more polymers selected from polyethylene, polyvinyl chloride, polypropylene, polyester, polystyrene, polyamide, and ethylene vinyl acetate. The bottom layer may comprise polyethylene terephthalate, or a suitable polyester. The bottom layer may comprise a needle-punched fabric. The top layer may have an anti-slip to surface. The top layer may comprise polypropylene or polyethylene terephthalate. The top layer may comprise a fabric material. The fabric material may comprise a spun-bonded, needle-punched, chemically bonded, or thermally-bonded fabric. The top layer may comprise indicia delineating the keyway portion.

In another aspect of the present invention, there is provided a foundation assembly. The foundation assembly comprises a footing defining a keyway; a moisture barrier on the footing, the moisture barrier comprising a keyway portion fit to the keyway on the footing and thus defining a secondary keyway; and a foundation wall on the moisture barrier, the foundation wall having first and second sides and a bottom, the bottom comprising a key portion received in the secondary keyway, wherein the moisture barrier comprises a waterproof layer for blocking passage of water through the moisture barrier, the waterproof layer having a bottom side and a top side; a bottom layer attached to the bottom side of the waterproof layer and binding the moisture barrier to the footing; and a top layer attached to the top side of the waterproof layer and in contact with the foundation wall. The foundation assembly may comprise a vapor barrier attached to the interior side of the foundation wall and a damp proofing attached to the exterior side of the foundation wall. The moisture barrier may be a moisture barrier described herein. The footing may comprise concrete. The foundation wall may comprise concrete.

In a further aspect of the present invention, there is provided a building comprising the foundation assembly described herein.

In another aspect of the present invention, there is provided a method of installing a foundation wall having a bottom key portion. The method comprises forming a footing, the footing defining a keyway; placing a moisture barrier on the footing, the moisture barrier comprising a flexible keyway portion fit to the keyway and thus defining a secondary keyway for receiving the bottom key portion of the foundation wall; and disposing the foundation wall on the moisture barrier on the footing to support the foundation wall with the footing, with the bottom key portion of the foundation wall being received in the secondary keyway, wherein the moisture barrier comprises a waterproof layer for blocking passage of water through the moisture barrier, the waterproof layer having a bottom side and a top side; a bottom layer attached to the bottom side of the waterproof layer and binding the moisture barrier to the footing; and a top layer attached to the top side of the waterproof layer and in contact with the foundation wall. The method may comprise, sequentially, forming a body of wet concrete; attaching the moisture barrier to a top surface of the body of wet concrete; and disposing the foundation wall on the moisture barrier. The wet concrete may be fully cured to form the footing after the attaching the moisture barrier to the body of wet concrete. The method may further comprise, after the moisture barrier is attached to the body of wet concrete and before the wet concrete is fully cured, pressing a section of the moisture barrier against the wet concrete to form the keyway and the secondary keyway. The foundation wall may comprise concrete. The moisture barrier may be a moisture barrier described herein.

Other aspects and features of the present invention will become apparent to those of ordinary skill in the art upon review of the following description of specific embodiments of the invention in conjunction with the accompanying figures.

BRIEF DESCRIPTION OF THE DRAWINGS

In the figures, which illustrate, by way of example only, embodiments of the present invention.

DETAILED DESCRIPTION

Figure 1:
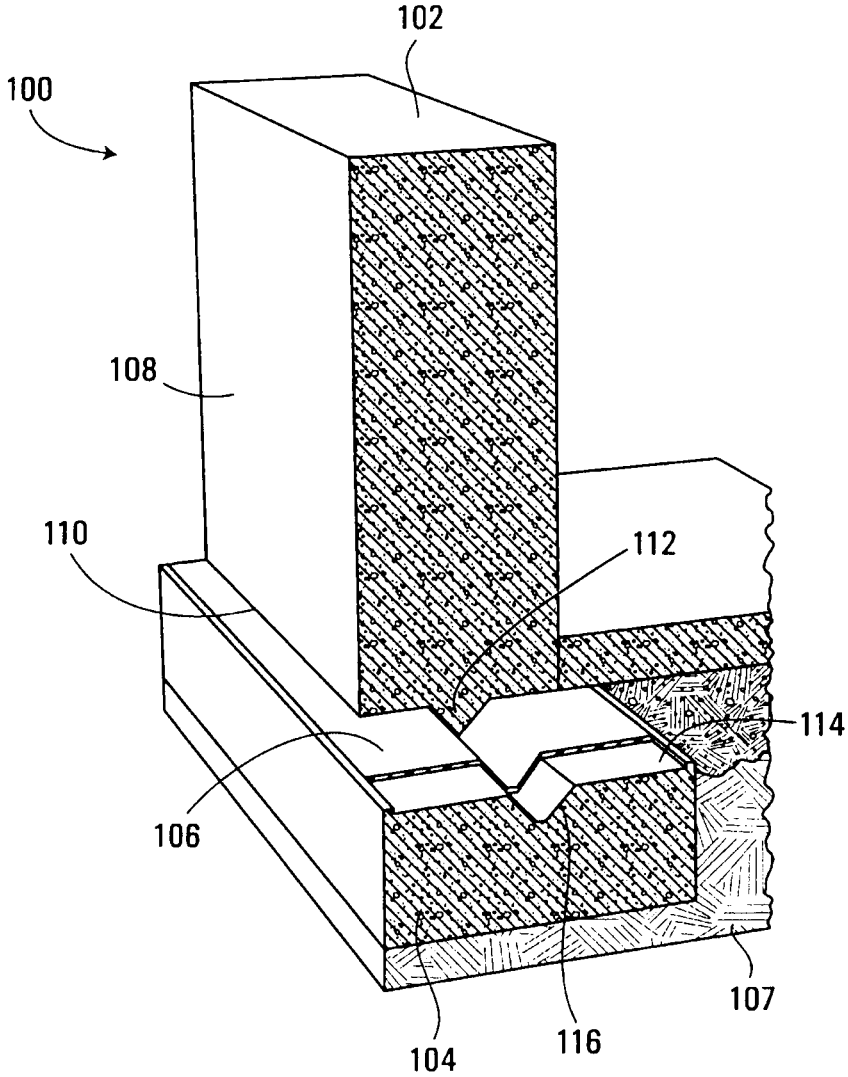
FIG. 1 is a perspective view of a foundation assembly, exemplary of an embodiment of the present invention.

FIG. 1 depicts a foundation assembly 100 in a building, exemplary of an embodiment of the present invention. Assembly 100 includes a foundation wall 102 (also referred to as stem wall), a footing 104 (also referred to as a footer) for supporting foundation wall 102, and a moisture barrier 106 (also referred to as footing barrier) sandwiched between foundation wall 102 and footing 104 for isolating them, exemplary of an embodiment of the present invention. Footing 104 may be disposed directly on soil 107.

Soil 107 and other unreferenced parts in FIG. 1 are depicted to provide context, but do not form part of assembly 100. In different embodiments, assembly 100 may include other components (either shown or not shown in FIG. 1) that may be used in a building construction as can be understood by those skilled in the art, such as flooring components, ceiling components, structural reinforcing components, thermal insulation components, finishes, or the like.

Foundation wall 102 has a side 108 and a bottom 110. A key 112 may protrude from bottom 110 for engaging footing 104. Key 112 may extend along a longitudinal central portion of the bottom surface of bottom 110. Foundation wall 102 may be made of any suitable material for foundation walls or stem walls. Typically, foundation wall 102 is formed mainly of poured concrete. In different embodiments, foundation wall may also be formed of wood, a concrete block, synthetic or composite materials, or the like. Foundation wall 102 may have any dimension, shape, or structure.

Additional features and structures, such as reinforcing materials, panels, studs, layers including thermal insulation layers and moisture/vapor barriers, drywalls, pipes, finishing, proofing, or the like (not shown) may be included in, or attached to, foundation wall 102, as may be appropriate depending on the particular application. For example, foundation wall 102 may form part of a basement wall (not shown in FIG. 1, but see FIG. 9).

Foundation wall 102 may be pre-fabricated or constructed at the building site as further described below.

Footing 104 has a top surface 114 for supporting moisture barrier 106 and, indirectly, foundation wall 102. A keyway 116 may be provided at top surface 114 of footing 104. Key 112 and keyway 116 are aligned and complementary in shape to tightly engage each other, to provide positional stability during construction and in the assembled structure. Footing 104 may be made of any suitable footing material. For example, footing 104 may include concrete. Additional features, rebars, reinforcements, or the like (not shown) may be included in or attached to footing 104. Footing may be pre-fabricated or constructed at the building site, as will be further described below. Typically, footing 104 is formed of poured concrete on site. Footing 104 may be exposed to water such as moisture during normal use after construction, for example, by capillary wicking. For example, footing 104 may be directly placed on the underlying soil, which can be wet for prolonged periods during use. Some footing materials, such as concrete, can potentially allow passage of water, such as by capillary action.

It has been recognized that, if foundation wall 102 is in direct contact with footing 104, a possible cause of water damage in the building wall that includes foundation wall 102 is water accumulation around foundation wall 102 near footing 104 due to capillary wicking through footing 104. For example, when footing 104 is made of concrete, small pores and fissures (not separately depicted in FIG. 1) present in the concrete can serve as capillary conduits and water can pass (rise up) through these pores and fissures of the concrete due to capillary action (also referred to as wicking). When the soil 107 surrounding footing 104 is wet, water from the wet soil 107 can continuously pass through footing 104 and reach the interface region between foundation wall 102 and footing 104. In the absence of a moisture barrier (such as moisture barrier 106) disposed between foundation wall 102 and footing 104, water can come into contact with, and accumulate around, foundation wall 102 near footing 104. The water can further rise up along foundation wall 102, for example, when foundation wall 102 is made of concrete or another material that can itself transport water by capillary action. When a vapor barrier (not shown in FIG. 1, but see FIG. 9) is applied to an entire side of foundation wall 102, the moisture rising from footing 102 can be trapped by the vapor barrier. As a result, the building wall or certain wall structures in the building wall around foundation wall 102 can become damaged, or even fail, due to prolonged exposure to water. As can be understood by those skilled in the art, installing a drainage system, such as the drainage system described in Read, near foundation wall 102 and footing 104 will not eliminate capillary action in footing 104, and will not prevent water from reaching foundation wall 102 through footing 104 by capillary action, when water is available in the soil 107 surrounding footing 104.

Conveniently, the potential damage and failure of the building wall caused by capillary wicking of water through footing 104 can be eliminated by isolating foundation wall 102 and footing 104 with moisture barrier 106, as illustrated in FIG. 1. Moisture barrier 106 blocks (breaks) the capillary path to foundation wall 102, thus preventing water from reaching foundation wall 102 by capillary wicking through footing 104.

Figure 2:
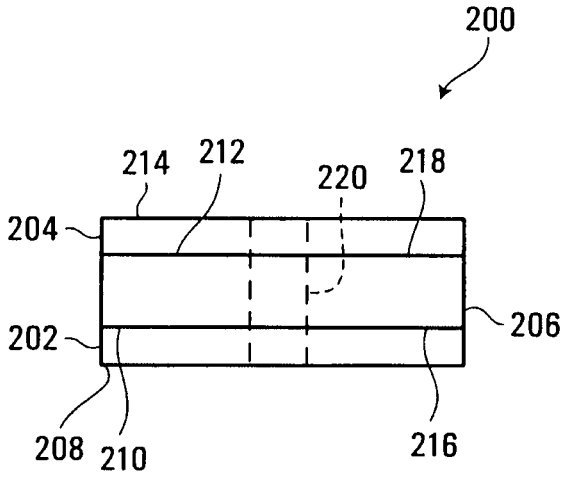
FIG. 2 is an elevation side view of a moisture barrier, exemplary of an embodiment of the present invention.
Figure 3:
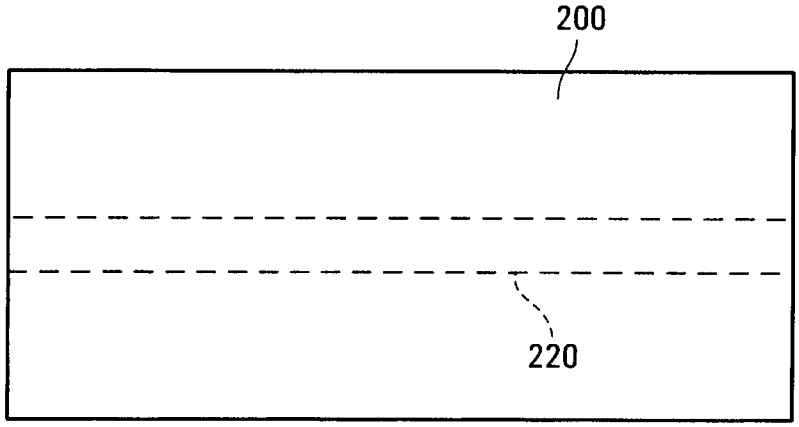
FIG. 3 is a top plan view of the moisture barrier of FIG. 2.

FIGS. 2 and 3 illustrate a moisture barrier 200, exemplary of an embodiment of the present invention that can be used to form moisture barrier 106.

Moisture barrier 200 includes a flexible, multi-layered sheet, which has a bottom layer 202, a top layer 204 and a middle layer 206 sandwiched between bottom layer 202 and top layer 204.

Bottom layer 202 has a bottom surface 208 and a top surface 210, and is adapted for reliable attachment, or binding, to footing 104. Bottom layer 202 may be attached and bonded to footing 104 through any suitable binding mechanism, including physical or chemical binding. For example, bottom layer 202 may be made of a material that attracts water and binds to cement. The material may be permeable to a fluid mixture of water and cement so that it can absorb water and cement from the wet concrete used to form footing 104. Bottom layer 202 may be formed of a needle-punched fabric. Bottom surface 208 of bottom layer 202 may also be adhesive to top surface 114 of footing 104. Bottom layer 202 may be formed from a suitable hydrophilic material, such as polyethylene terephthalate (PET), and may be provided as a fabric, either woven or non-woven.

In one embodiment, a PET needle-punched fabric may be used to form bottom layer 202. In other embodiments, other geotextiles may be used. A suitable polyester material may be used. The geotextile material may include a needle-punched, heat bonded, or woven fabric. The thickness of bottom layer 202 may be from about 0.2 mm to about 5 mm.

Top layer 204 has a bottom surface 212 and a top surface 214. Top layer 204 is formed of a material selected to provide sufficient friction (traction) on the top surface 214 to prevent slippage (anti-slip). When the top surface 214 of layer 204 provides sufficient friction or traction to reduce or prevent slippage on the surface, it allows the workers to safely walk or stand on moisture barrier 200 during construction of the building. Top surface 214 of top layer 204 may also provide sufficient traction for conveniently writing thereon with a chalk, as the chalk is unlikely to slip on an anti-slip surface. This can allow a worker to conveniently make marks on the moisture barrier, for example, to draw lines to mark positions and directions of keyways, or placement of concrete or formwork for pouring concrete. The material for top layer 204 may also be selected so that it can withstand the rough working conditions on a construction site. Top layer 204 may be formed of polypropylene (PP) or another suitable polymer such as PET, and may be in the form of a spun-bonded fabric. Top layer may also be formed of a needle-punched, chemically-bonded, thermally(heat)-bonded, or woven fabric. While different types of fabric materials may be used, spun-bonded fabric may be relatively inexpensive to produce, and can still provide sufficient strength, durability, and anti-slip properties appropriate or required for the intended use. Spun-bonded fabric can conveniently allow marking thereon with a chalk and can provide an anti-slip surface. The thickness of top layer 204 may be from about 0.2 mm to about 5 mm.

Middle layer 206 is formed of a flexible waterproof material that blocks passage of both liquid water and water vapor by capillary wicking. The waterproof material has a permeability rating that is considered suitable for use as a vapor barrier or vapor retarder according to industry standards. For example, the permeability rating of the middle layer may be less than 57 $ng/s \cdot m^2 \cdot Pa$ based on the ASTM-E96 Water Vapor Transmission Test. A suitable waterproof material is polyethylene. Other suitable polymer materials may include polyvinyl chloride (PVC), polypropylene, polyester, polystyrene, polyamide, ethylene vinyl acetate (EVA), or the like. A combination of different materials may also be used in middle layer 206. The thickness of middle layer 206 may be from about 0.1 mm to about 3 mm.

Layers 202, 204, 206 of moisture barrier 200 may be bonded to each other in any suitable manner. For example, the layers may be chemically bonded or physically bonded, such as being thermally bonded, glued, stitched or stapled together.

In this embodiment, moisture barrier 200 is pliable, adhesive to concrete, and can prevent capillary wicking therethrough.

Optionally, moisture barrier 200 may also provide thermal insulation.

Moisture barrier 200 may be sufficiently flexible so that it can be rolled to form a roll, and can conform to the top surface of footing 104 and bottom surface of foundation wall 102, which may not be perfectly flat.

For example, when key 112 and keyway 116 are to be provided on foundation wall 102 and footing 104 respectively, a corresponding central section 220 (referred to as keyway section 220) of moisture barrier 200 should be sufficiently flexible to conform to the shapes of key 112 and keyway 116 to allow reliable engagement therebetween. Keyway section 220 may have a width similar to, or greater than, the width of keyway 116. Alternatively, moisture barrier 200 may be made of the same materials across its width and is sufficiently flexible to allow keyway formation and key/keyway engagement. To assist keyway formation and alignment of foundation wall 102 and footing 104 during construction or installation, physical markings may be provided on moisture barrier 200 to mark the intended key/keyway lines. Such markings may be provided by inked lines, different colors, different material surface textures, or any other suitable indicia.

For convenient use, moisture barrier 200 may have a substantially rectangular shape, as depicted in FIG. 3, and may be sized to cover the full width of a section of surface 114 of footing 104. For example, the moisture barrier 200 may have a width of about 0.45 m. Moisture barrier 200 may be provided in a roll with a length of, for example, about 25 m. The width of moisture barrier 200 may be selected to match the width of footing 104, or to be at least as wide as the thickness of foundation wall 102.

However, in different applications, the size and shape of moisture barrier 200 may vary and may be different from those depicted in the drawings.

For convenient use, the top and bottom surfaces of moisture barrier 200 may have different, identifiable colors or readily noticeable labels or markings to assist users to readily determine which side is the top side and which side is the bottom side. For example, the top side may have a blue color and the bottom side may have a grey color. A side may also have printed indicia that indicate whether it is a top side or bottom side.

Foundation assembly 100 may be constructed as part of a building, as illustrated in FIGS. 4 to 8, according to an exemplary embodiment of the present invention.

Figure 4:
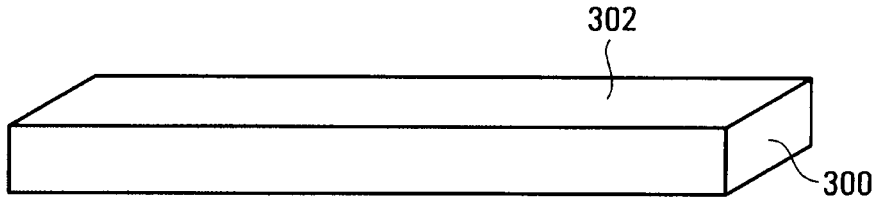
FIG. 4 is a perspective view of a footing formed of poured concrete.

As shown in FIG. 4, a body of poured concrete 300 for forming footing 102 is initially formed directly on underlying soil (not shown). Formwork or another suitable type of mold may be provided to define the shape of poured concrete 300. Wet concrete, which includes cement and water, may be poured into the formwork or mold. Suitable concrete and cement materials may be selected depending on the particular application. Additional materials such as reinforcing materials (not shown) may be included in poured concrete 300. For example, steel wires or rebars may be embedded in poured concrete 300. The top surface 302 of poured concrete 300 is exposed and may be leveled and treated as appropriate, as can be understood by those skilled in the art. While it is not necessary for the top surface of poured concrete 300 to be completely flat before applying moisture barrier 200, it may be convenient for later processing if top surface 302 is generally flat.

Figure 5:
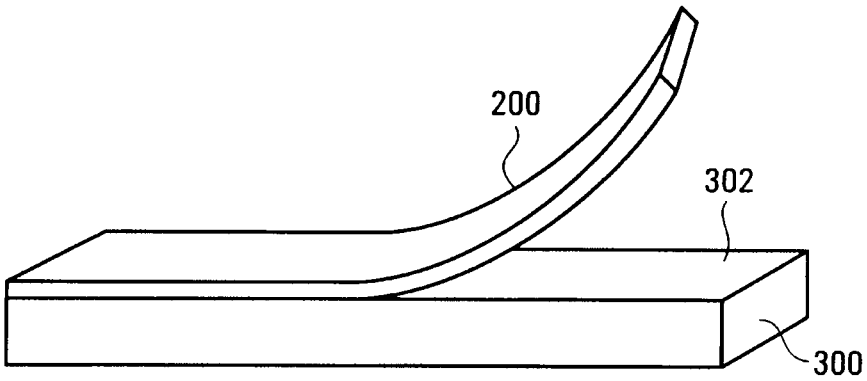
FIG. 5 is a perspective view of the moisture barrier of FIG. 2 being attached to the poured concrete of FIG. 4.

As illustrated in FIG. 5, while the concrete material in poured concrete 300 is still wet and deformable (i.e. before it is cured), moisture barrier 200 is applied to top surface 302 of poured concrete 300 with bottom layer 202 in contact with poured concrete 300. In some applications, installation of moisture barrier 200 may begin as soon as poured concrete 300 has been poured and leveled.

When bottom layer 202 of moisture barrier 200 is in contact with wet concrete, it can attract and absorb water, with some dissolved cement material or suspended cement particles. Thus, as the concrete is cured, bottom layer 202 will be securely attached to (bonded to or even partially embedded in) the resulting solid concrete.

While only one piece of moisture barrier 200 is depicted in FIG. 5, multiple pieces of moisture barriers may be used to cover a section of the footing concrete, or the entire footing concrete. For example, multiple pieces of moisture barrier 200 may be placed side by side or head to toe. The edges of adjacent moisture barriers 200 may overlap by a sufficient length to prevent leakage of water through the gaps between the pieces. For example, in one embodiment, the adjacent pieces may overlap by about 1 to about 2 cm.

Further, while as depicted, the entire top surface 302 is covered, in different applications, only a portion of the top surface of the footing may be covered with a moisture barrier, as long as the footing and the foundation wall is isolated from each other by the moisture barrier. In such cases, moisture barrier(s) 200 may be applied to cover the portions of poured concrete 300 that is to be directly underneath, or in proximity to, foundation wall 102. For example, when a keyway will be used, moisture barrier 200 may be applied along the desired keyway line.

At the end of application of moisture barrier 200, any extra portion of moisture barrier 200 may be conveniently cut with a cutting tool, such as a utility knife.

Sometimes, a projection, such as a rebar (not shown), may project from top surface 302 of poured concrete 300. In such a case, an opening may be provided in moisture barrier 200 to allow the projection to pass through during installation. The opening may be conveniently provided, for example, by forming an "X" shaped cut in moisture barrier 200 at the location where the projection is to pass through.

As the bottom surface of moisture barrier 200 can bind or adhere to wet concrete surface, it is not necessary to hold down the moisture barrier with weight during installation.

Further, bottom layer 202 of moisture barrier 200 is permeable to and can absorb fluid footing materials, such as water and small cement particles suspended in water, from poured concrete 300, and the absorbed materials will facilitate binding between poured concrete 300 and moisture barrier 200 when the concrete is dried and cured, as discussed earlier. Conveniently, the absorbed material also helps to stabilize moisture barrier 200 on top of poured concrete 300 by increasing its weight.

As can be appreciated, as moisture barrier 200 can securely attach to, or bond with, footing 104, it will not be easily displaced during subsequent construction process, such as during gravel placement, which may involve throwing gravel or crushed-rock at high speeds towards footing 104 with a "stone slinger" machine.

Figure 6:
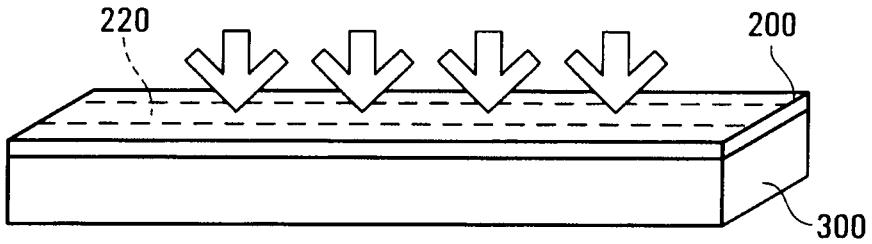
FIG. 6 is a perspective view of the moisture barrier attached to the poured concrete of FIG. 4.

In the present embodiment shown in FIGS. 4 to 8, a keyway is to be formed in poured concrete 300. As illustrated in FIG. 6, the keyway may be formed by applying downward pressure along markings that indicate the keyway section 220 on moisture barrier 200. The pressure may be applied using any suitable technique. For example, a block of solid material (not shown) with a suitable size may be used. In some cases, a 2×4 wooden bar may be conveniently used to apply the pressure.

In some applications, the keyway section 220 marked on moisture barrier 200 may conveniently assist the user to determine the position and direction of the keyway line. For example, the side edges of moisture barrier 200 may be aligned with fixed markers and the keyway is then formed based on the direction and position of the keyway section 220.

Figure 7:
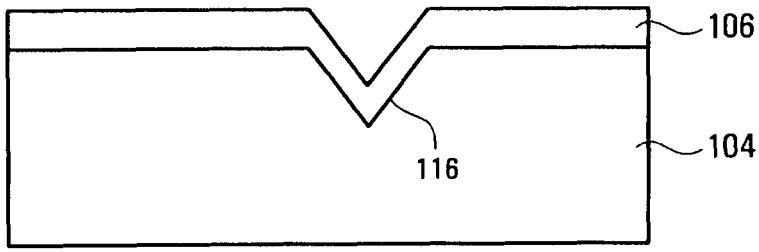
FIG. 7 is a cross-sectional view of a moisture barrier and a footing formed by applying pressure to the structure of FIG. 6.

As shown in FIG. 7, the resulting concrete body forms footing 104 with keyway 116. Moisture barrier 200 adheres to the wet concrete surface of footing 104 and conforms to the shape of keyway 116, thus forming moisture barrier 106.

In the present embodiment, the concrete in footing 104 is fully cured only after attachment of moisture barrier 200 to poured concrete 300 and formation of keyway 116.

Figure 8:
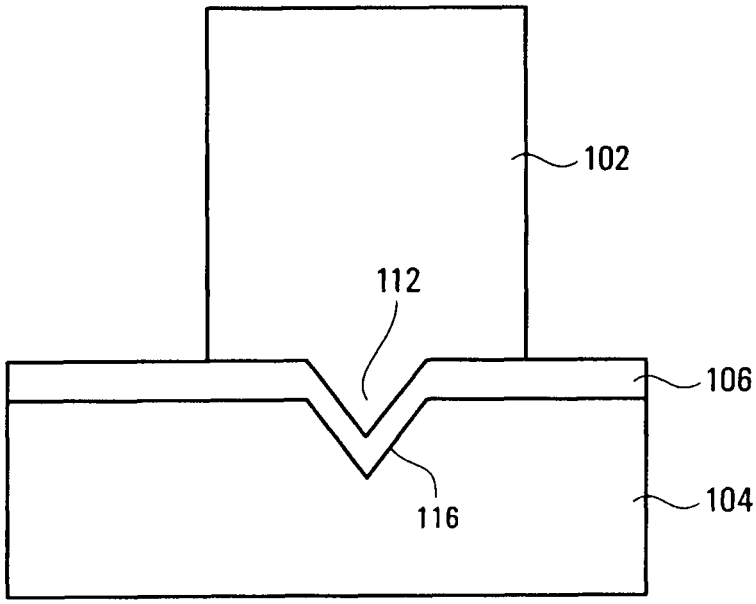
FIG. 8 is a cross-sectional view of a foundation wall installed on top of the moisture barrier and footing of FIG. 7.

As illustrated in FIG. 8, foundation wall 102 is next disposed on top of moisture barrier 106. Foundation wall 102 may be fabricated off-site and installed after footing 104 is cured. Alternatively, foundation wall 102 may be built on-site and construction of foundation wall 102 may begin before or after footing 104 is fully cured.

For example, when foundation wall 102 is made of concrete, a formwork (not shown) for forming foundation wall 102 may be constructed or installed, and the concrete for foundation wall 102 may be poured in to the formwork after keyway 116 has been formed, and while the concrete in footing 102 is still curing.

Figure 9:
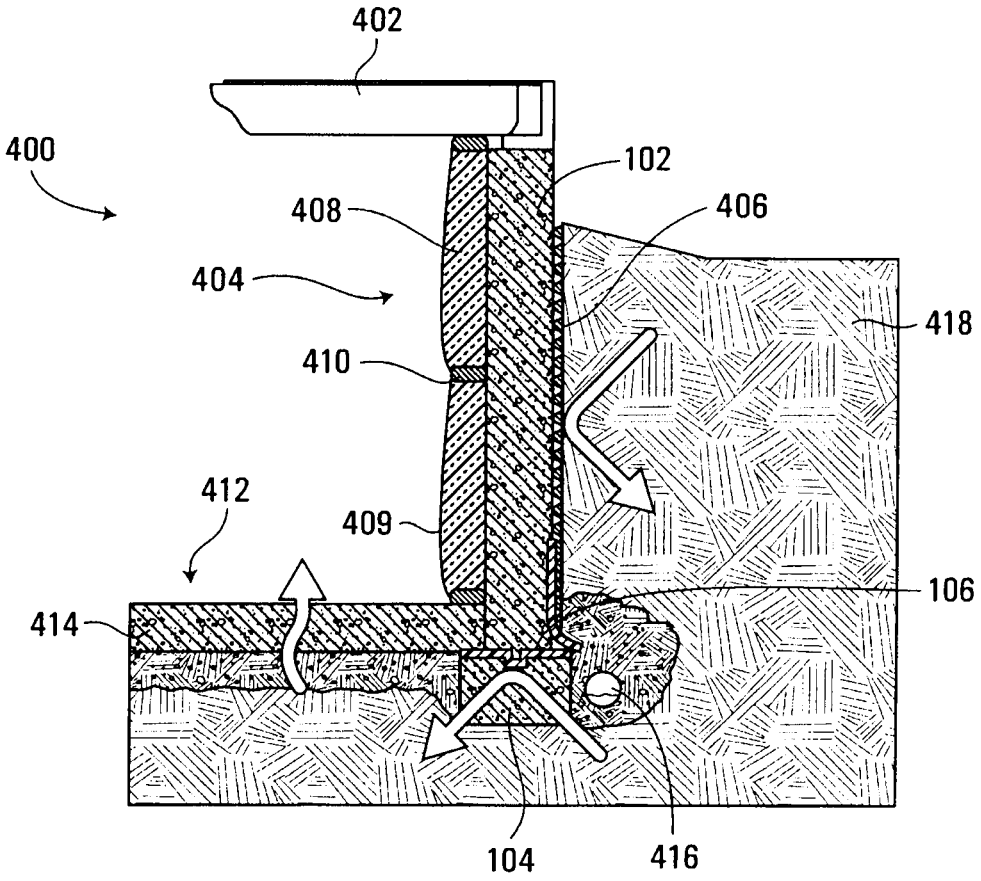
FIG. 9 is a partial cross-sectional view of a basement in a building.

A foundation assembly described herein, such as foundation assembly 100 of FIG. 1, may be used, as illustrated in FIG. 9, to form a part of a building 400, which may be a residential, public, or commercial building. Building 400 may include a basement 402, and assembly 100 may form a part of basement 402, as depicted in FIG. 9. Basement 402 is partially underground and has a side wall 404, which includes foundation wall 102, damp proofing 406 attached to the exterior side of foundation wall 102, an interior insulation layer 408 and a vapor barrier 409 attached to the interior side of foundation wall 102, and frame/stud 410. Damp proofing 406 may include any suitable material for damp proof, such as in the form of a water proof sheet or tar. Insulation layer 408 provides thermal insulation. Vapor barrier 409 may be formed of any suitable waterproof material. Basement 402 also has a floor 412, which includes a concrete floor slab 414. Foundation wall 102 is supported on footing 104 indirectly and is isolated from footing 104 by moisture barrier 106. A drainage system 416 may also be provided as part of basement wall 404.

As can be appreciated, damp proofing 406, vapor barrier 409, and drainage system 416 can reduce the risk of water damage in basement wall 404, by preventing water from entering into wall 404 through the sides and by collecting water from surrounding soil 418 and interior moisture from inside wall 404. As depicted in FIG. 9, a large portion of side wall 404 may be in contact with surrounding soil 418. To fully protect foundation wall 102 from water attack from surrounding soil 418, damp proofing 406 may need to extend over the full height of foundation wall 102. In such cases, the risk of water accumulation and water damage within side wall 404 can be significantly further reduced by the presence of moisture barrier 106, as moisture barrier 106 between foundation wall 102 and footing 104 can conveniently prevent water accumulation in the foundation wall 102 through footing 104 by way of capillary wicking. If moisture barrier 106 is absent, water may pass from soil 418 to foundation wall 102 through footing 104 and any water accumulated around foundation wall 102 between damp proofing 406 and vapor barrier 409 will not be able to escape and will be likely trapped inside side wall 404 for a long period of time, due to blockage by damp proofing 406 and vapor barrier 409.

Building 400 may be constructed and may include parts and components as described in the literature or as used in known practices, with the modifications necessary to implement features of the exemplary embodiments disclosed herein. For example, the following literature references may be consulted for constructing building 400: *Best Practice Guide: Full Height Basement Insulation*, by Ministry of Municipal Affairs and Housing, 2008, available online at <http://www.ontario.ca/buildingcode> under Menu item "Publications"; "*Builder's Guide to Cold Climates*" by Joseph Lstiburek, Building Science Corporation, 2006; *"Builder's Guide to Mixed-Humid Climates,"* by Joseph Lstiburek, Building Science Corporation, 2005; *"Builder's Guide to Hot-Dry & Mixed-Dry Climates,"* by Joseph Lstiburek, Building Science Corporation, 2004; *"Builder's Guide to Hot-Humid Climates,"* by Joseph Lstiburek, Building Science Corporation, 2005; *"Performance Guidelines for Basement Envelope Systems and Materials,"* by Michael C. Swinton and Ted Kesik, National Research Council of Canada, 2005; and "*Builder's Foundation Handbook,*" by John Carmody and Jeffery Christian, Kenneth Labs, Oak Ridge National Laboratory, 1991.

As now can be understood, the embodiments described herein may be modified to suit the needs in different applications, as long as an effective moisture barrier is placed between the footing and the foundation wall supported by the footing to break the capillary path from the footing to the foundation wall. Embodiments of the present invention may have applications in various buildings or construction processes where water damage to the foundation wall is of concern.

Embodiments of the present invention are further illustrated by the following non-limiting examples.

EXAMPLE

Working embodiments of moisture barrier 200 were produced in mass production. The produced sample moisture barriers were three-layer sheets, where the bottom layer was a needle-punched fabric made of polyethylene terephthalate; the top layer was a spun-bonded fabric made of polypropylene; and the middle waterproof layer was made of polyethylene.

The roll size for the production sheet is 0.45 m by 25 m. The expected lifetime of the sheet in soil at temperatures below 20° C. is 25 years or more.

EXAMPLE I

Sample moisture barriers were tested for water vapor transmission based on ASTM E96/E96M-05 Procedure A. The test conditions were: Procedure A (desiccant method at 23° C.); relative humidity, 50%; container material, aluminum; exposed area, 63.62 $cm^2$; composition of sealant, microcrystalline wax; testing period, one week. Representative test results are listed in Table I.

TABLE I

| | test 1 | test 2 | test 3 | Average | S.D. | % CV |
|---|---|---|---|---|---|---|
| Specimens thickness (mm) | 1.40 | 1.19 | 1.19 | | | |
| Water vapor transmission ($g/m^2 \cdot 24$ h) | 4.99 | 6.91 | 5.72 | 5.87 | 0.97 | 16.5 |
| Permeance ($ng/Pa/s/m^2$) | 41.1 | 56.9 | 47.1 | 48.4 | 8.0 | 16.5 |

EXAMPLE II

Sample moisture barriers were also tested for tensile properties based on ASTM D882-02. The test conditions were: samples conditioned at 21° C., 65% R.H; apparatus used: Dynamometer, with Constant Rate of Extension (CRE) speed; 5 test specimens per direction cut with a die; type of grips, hydraulic grips (rubber coated); crosshead speed, 50 mm/min; grip separation (initial), 100 mm; test specimen width and length, 25.4 mm×152.4 mm. Representative test results for tensile strength in machine direction are listed in Table II. Representative test results for tensile strength in cross direction are listed in Table III.

TABLE II

| Tests in Machine Direction | | |
|---|---|---|
| | Tensile strength (kN/m) | Elongation at tensile strength (%) |
| test 1 | 5.19 | 72.6 |
| test 2 | 6.06 | 81.1 |
| test 3 | 6.16 | 50.3 |
| test 4 | 6.00 | 59.7 |
| test 5 | 4.75 | 63.2 |
| Average | 5.63 | 65.4 |
| S.D. | 0.63 | 11.9 |
| % CV | 11.1 | 18.2 |

TABLE III

| Tests in Cross Direction | | |
|---|---|---|
| | Tensile strength (kN/m) | Elongation at tensile strength (%) |
| test 1 | 2.13 | 125.2 |
| test 2 | 1.55 | 146.8 |
| test 3 | 1.13 | 117.7 |
| test 4 | 2.12 | 110.3 |
| test 5 | 1.53 | 151.7 |
| Average | 1.69. | 130.3 |
| S.D. | 0.43 | 18.1 |
| % CV | 25.4 | 13.9 |

EXAMPLE III

Sample moisture barriers were tested for impact resistance by the free-falling dart method, based on ASTM D1709-02, method B. The test conditions were: samples conditioned at 23° C., 50% R.H; Method B, staircase testing technique with a dart of 50.8 mm diameter head; weight used, 1348 g, 1396 g, 1444 g, 1492.7 g, 1541.1 g, 1589.5 g and 1638 g. A failure was recorded when the dart completely went through the sample sheet. A total of 20 specimens were tested. The weight increment was 48.3 g. The observed results were: impact failure weight, 1497 g; lowest weight with failure, 1396 g; and highest weight without failure, 1590 g.

EXAMPLE IV

Sample moisture barriers were tested to determine their resistance to water penetration based on the hydrostatic pressure test of ISO 811-1981. The test conditions were: samples conditioned at 21° C., 65% R.H; apparatus used, Textest™ Hydrostatic Head Tester, Model FX 30000; water pressure applied from below the test specimen; 5 test specimens per product; temperature of distilled water, 20° C.; increment speed of water pressure, 60 cm water/min; side of fabric tested, coated. Representative test results are listed in Table IV.

TABLE IV

| | Resistance to water penetration (cm) |
|---|---|
| test 1 | 76.0 |
| test 2 | 94.5 |
| test 3 | 93.5 |
| test 4 | 75.5 |
| test 5 | 92.0 |
| Average | 86.3 |
| S.D. | 9.7 |
| % CV | 11.2 |

EXAMPLE V

Sample moisture barriers were tested to determine the stiffness of fabrics, based on ASTM D1388-07a. The test conditions were: samples conditioned at 23±1° C., 50±2% R.H; apparatus used, stiffness tester; Option A, Cantilever test; 5 test specimens per direction and 4 measurements per specimen. Representative test results for tests in machine direction are listed in Table V. Representative test results for tests in cross direction are listed in Table VI.

TABLE V

| | Bending Length (mm) | Flexural rigidity (μJ/m) |
|---|---|---|
| Stiffness in Machine Direction | | |
| test 1 | 62 | 7.03 |
| test 2 | 73 | 13.6 |
| test 3 | 66 | 8.76 |
| test 4 | 69 | 10.1 |
| Average | 68 | 9.9 |
| S.D. | 5 | 2.8 |
| % CV | 6.9 | 28.2 |
| Stiffness in Cross Direction | | |
| test 1 | 42 | 2.51 |
| test 2 | 42 | 2.51 |
| test 3 | 40 | 1.80 |
| test 4 | 41 | 2.09 |
| Average | 41 | 2.23 |
| S.D. | 1 | 0.35 |
| % CV | 2.3 | 15.6 |

EXAMPLE VI

Sample moisture barriers were tested for water vapor transmission based on ASTM E96/E96M-05 Procedure B. The test conditions were: Procedure B (water method at 23° C.); relative humidity, 50%; container material, aluminum; exposed area, 63.62 $cm^2$; composition of sealant, microcrystalline wax; testing period, 3 days. Representative test results are listed in Table VII.

TABLE VII

| | Specimens thickness (mm) | Water vapor transmission ($g/m^2 \cdot 24$ h) | Permeance ($ng/Pa/s/m^2$) |
|---|---|---|---|
| test 1 | 1.09 | 7.22 | 59.5 |
| test 2 | 1.22 | 8.29 | 68.3 |
| test 3 | 1.14 | 8.00 | 65.9 |
| Average | | 7.84 | 64.6 |
| S.D. | | 0.55 | 4.5 |
| % CV | | 7.1 | 7.0 |

Of course, the above described embodiments are intended to be illustrative only and in no way limiting. The described embodiments are susceptible to many modifications of form, arrangement of parts, details and order of operation. The invention, rather, is intended to encompass all such modification within its scope, as defined by the claims.

What is claimed is:

1. A moisture barrier for isolating a foundation wall from a footing in a building, comprising:

a waterproof layer for blocking passage of water through said moisture barrier, said waterproof layer having a bottom side and a top side;

a bottom layer attached to said bottom side of said waterproof layer, for attaching said moisture barrier to the footing, said bottom layer formed of a water permeable material that absorbs water and binds to cement; and a top layer attached to said top side of said waterproof layer, for contacting the foundation wall, wherein said moisture barrier comprises a keyway portion, said keyway portion being sufficiently flexible and being configured to fit a keyway in the footing.

2. The moisture barrier of claim 1, wherein said waterproof layer comprises one or more polymers selected from polyethylene, polyvinyl chloride, polypropylene, polyester, polystyrene, polyamide, and ethylene vinyl acetate.

3. The moisture barrier of claim 1, wherein said bottom layer comprises polyethylene terephthalate.

4. The moisture barrier of claim 1, wherein said top layer has an anti-slip top surface.

5. The moisture barrier of claim 1, wherein said top layer comprises polypropylene or polyethylene terephthalate.

6. The moisture barrier of claim 1, wherein said top layer comprises a fabric material.

7. The moisture barrier of claim 6, wherein said fabric material comprises a spun-bonded, needle-punched, chemically bonded, or thermally-bonded fabric.

8. The moisture barrier of claim 7, wherein said top layer comprises indicia delineating said keyway portion.

9. The moisture barrier of claim 1, wherein said bottom layer is formed of at least one of a spun bond or needle punched fabric.

10. A foundation assembly, comprising:

a footing defining a keyway;

a moisture barrier on said footing, said moisture barrier comprising a keyway portion fit to said keyway on said footing and thus defining a secondary keyway; and a foundation wall on said moisture barrier, said foundation wall having an interior side, an exterior side, and a bottom, said bottom comprising a key portion received in said secondary keyway, wherein said moisture barrier comprises a waterproof layer for blocking passage of water through said moisture barrier, said waterproof layer having a bottom side and a top side;

a bottom layer formed of a water permeable material that absorbs water and binds to cement and is attached to said bottom side of said waterproof layer and binding said moisture barrier to said footing; and a top layer attached to said top side of said waterproof layer and in contact with said foundation wall.

11. The foundation assembly of claim 10, comprising a vapor barrier attached to said interior side of said foundation wall and a damp proofing attached to said exterior side of said foundation wall.

12. The foundation assembly of claim 10, wherein said footing comprises concrete.

13. The foundation assembly of claim 10, wherein said foundation wall comprises concrete.

14. A building comprising the foundation assembly of claim 10.

15. The foundation assembly of claim 10, wherein said bottom layer is formed of at least one of a spun bond or needle punched fabric.

16. A method of installing a foundation wall having a bottom key portion, comprising:

forming a footing, said footing defining a keyway;

placing a moisture barrier on said footing, said moisture barrier comprising a flexible keyway portion fit to said keyway and thus defining a secondary keyway for receiving said bottom key portion of said foundation wall; and disposing said foundation wall on said moisture barrier on said footing to support said foundation wall with said footing, with said bottom key portion of said foundation wall being received in said secondary keyway, wherein said moisture barrier comprises a waterproof layer for blocking passage of water through said moisture barrier, said waterproof layer having a bottom side and a top side;

a bottom layer formed of a water permeable material that absorbs water and binds to cement and is attached to said bottom side of said waterproof layer and binding said moisture barrier to said footing; and a top layer attached to said top side of said waterproof layer and in contact with said foundation wall.

17. The method of claim 16, comprising, sequentially, forming a body of wet concrete;

attaching said moisture barrier to a top surface of said body of wet concrete; and disposing said foundation wall on said moisture barrier, wherein said wet concrete is fully cured to form said footing after said attaching said moisture barrier to said body of wet concrete.

18. The method of claim 17, further comprising, after said moisture barrier is attached to said body of wet concrete and before said wet concrete is fully cured, pressing a section of said moisture barrier against said wet concrete to form said keyway and said secondary keyway.

19. The method of claims 16, wherein said foundation wall comprises concrete.

20. A method of installing a foundation wall having a bottom key portion, comprising:

forming a footing, said footing defining a keyway;

placing a moisture barrier on said footing, said moisture barrier comprising a flexible keyway portion fit to said keyway and thus defining a secondary keyway for receiving said bottom key portion of said foundation wall; and disposing said foundation wall on said moisture barrier on said footing to support said foundation wall with said footing, with said bottom key portion of said foundation wall being received in said secondary keyway, wherein said moisture barrier comprises a waterproof layer for blocking passage of water through said moisture barrier, said waterproof layer having a bottom side and a top side;

a bottom layer comprising a needle punched fabric attached to said bottom side of said waterproof layer and binding said moisture barrier to said footing; and a top layer attached to said top side of said waterproof layer and in contact with said foundation wall;

comprising, sequentially, forming a body of wet concrete;

attaching said moisture barrier to a top surface of said body of wet concrete; and disposing said foundation wall on said moisture barrier, wherein said wet concrete is fully cured to form said footing after said attaching said moisture barrier to said body of wet concrete.

* * * * *